US011959705B2

(12) United States Patent
Wei et al.

(10) Patent No.: US 11,959,705 B2
(45) Date of Patent: Apr. 16, 2024

(54) HEAT EXCHANGER AND AIR CONDITIONER WITH HEAT EXCHANGER

(71) Applicant: ZHEJIANG DUNAN ARTIFICIAL ENVIRONMENT CO., LTD., Zhejiang (CN)

(72) Inventors: Wenjian Wei, Zhejiang (CN); Wenyong Ma, Zhejiang (CN)

(73) Assignee: ZHEJIANG DUNAN ARTIFICIAL ENVIRONMENT CO., LTD., Zhejiang (CN)

( * ) Notice: Subject to any disclaimer, the term of this patent is extended or adjusted under 35 U.S.C. 154(b) by 494 days.

(21) Appl. No.: 17/312,962

(22) PCT Filed: Oct. 28, 2019

(86) PCT No.: PCT/CN2019/113746

§ 371 (c)(1),
(2) Date: Jun. 11, 2021

(87) PCT Pub. No.: WO2020/119290

PCT Pub. Date: Jun. 18, 2020

(65) Prior Publication Data

US 2022/0049903 A1 Feb. 17, 2022

(30) Foreign Application Priority Data

Dec. 13, 2018 (CN) ..... 201811526281.9

(51) Int. Cl.

| | |
|---|---|
| ***F28D 1/03*** | (2006.01) |
| ***F28F 3/04*** | (2006.01) |
| ***F28F 3/08*** | (2006.01) |

(52) U.S. Cl.
CPC ..... *F28D 1/035* (2013.01); *F28F 3/044* (2013.01); *F28F 3/08* (2013.01); *F28F 2260/02* (2013.01)

(58) Field of Classification Search
CPC ... F28D 1/035; F28F 3/044; F28F 3/08; F28F 2260/02
USPC ..... 165/148
See application file for complete search history.

(56) References Cited

U.S. PATENT DOCUMENTS

| | | | | |
|---|---|---|---|---|
| 4,800,954 | A * | 1/1989 | Noguchi | F28F 3/044 165/DIG. 466 |
| 7,264,045 | B2 * | 9/2007 | Mehendale | F28D 1/0341 165/170 |
| 9,033,030 | B2 * | 5/2015 | Des Champs | F28F 3/044 165/146 |
| 10,145,295 | B2 * | 12/2018 | Berger | F02B 29/0462 |
| 10,794,638 | B2 * | 10/2020 | Vucenic | F28F 3/048 |
| 10,830,540 | B2 * | 11/2020 | Sennoun | F28D 1/05391 |
| 10,914,533 | B2 * | 2/2021 | Somhorst | F28D 1/0333 |

(Continued)

FOREIGN PATENT DOCUMENTS

| | | | | |
|---|---|---|---|---|
| CA | 3048937 C | * | 5/2021 | F28D 9/005 |
| CA | 3039275 C | * | 6/2021 | F28D 9/0037 |

(Continued)

*Primary Examiner* — Jon T. Schermerhorn, Jr.
(74) *Attorney, Agent, or Firm* — Samson G. Yu

(57) ABSTRACT

The disclosure provides a heat exchanger and an, air conditioner with the heat exchanger. A heat exchange assembly includes a first channel and a second channel which are used for allowing a refrigerant to pass through, a communication portion communicated with the first channel and the second channel, and a plurality of protrusions.

20 Claims, 5 Drawing Sheets

(56) References Cited

U.S. PATENT DOCUMENTS

| | | | | |
|---|---|---|---|---|
| 10,989,482 | B2 * | 4/2021 | Granryd | F28D 9/005 |
| 11,015,468 | B2 * | 5/2021 | Zaccardi | F01D 9/041 |
| 11,133,538 | B2 * | 9/2021 | Ge | H01M 10/6556 |
| 11,326,837 | B2 * | 5/2022 | Vakilimoghaddam | H01M 10/6568 |
| 11,639,828 | B2 * | 5/2023 | Wright | F28D 1/035 165/185 |
| 2008/0041556 | A1 * | 2/2008 | Braun | F28F 3/044 165/41 |
| 2016/0036104 | A1 * | 2/2016 | Kenney | F28F 3/12 165/170 |
| 2021/0396479 | A1 * | 12/2021 | Tissot | F28F 3/044 |
| 2021/0404749 | A1 * | 12/2021 | Wexler | F28F 3/044 |
| 2022/0074670 | A1 * | 3/2022 | Wei | F28F 1/025 |
| 2023/0324128 | A1 * | 10/2023 | Choi | F28D 9/0093 165/140 |

FOREIGN PATENT DOCUMENTS

| | | | | | |
|---|---|---|---|---|---|
| CN | 101589286 | A | | 11/2009 | |
| CN | 209623416 | U | | 11/2019 | |
| CN | 112414178 | A | * | 2/2021 | |
| CN | 115406273 | A | * | 11/2022 | |
| FR | 2933015 | B1 | | 9/2010 | |
| FR | 3093556 | A1 | * | 9/2020 | F28D 9/0056 |

* cited by examiner

HEAT EXCHANGER AND AIR CONDITIONER WITH HEAT EXCHANGER

CROSS-REFERENCE TO RELATED APPLICATION(S)

The present invention is a national stage application of International Patent Application No. PCT/CN2019/113746, which is filed on Oct. 28, 2019 and claims priority to Chinese Patent Application No. 201811526281.9, filed on Dec. 13, 2018 and entitled "Heat Exchanger and Air Conditioner with Heat Exchanger", the contents of which are hereby incorporated by reference in its entirety.

TECHNICAL FIELD

The present disclosure relates to a technical field of heat exchange devices, and in particular to a heat exchanger and an air conditioner with the heat exchanger.

BACKGROUND

In a related art, a core of a conventional microchannel heat exchanger is mainly manufactured by using a microchannel flat tube, a fin, a side plate, and a collecting pipe. While the conventional double-row microchannel heat exchanger is bent, a section of a core portion without the fin needs to be reserved in a bending area (as shown in FIG. 1). In the case of the same heat exchange capacity, the length of the heat exchanger is longer, so that the manufacturing cost of the heat exchanger is increased. In addition, in the related art, there is usually a gap of 4 mm to 7 mm between double-row cores of the double-row microchannel heat exchanger, so that the heat exchanger requires a larger mounting space, and the use of the heat exchanger is limited.

SUMMARY

A main purpose of the present disclosure is to provide a heat exchanger and an air conditioner with the heat exchanger, as to solve problems in a related art that a double-row bending heat exchanger is high in cost and large in mounting space in the case of the same heat exchanger capacity.

In order to achieve the above purpose, according to one aspect of the present disclosure, a heat exchanger is provided, including a plurality of heat exchange assemblies and a fin, the fin is located between two adjacent heat exchange assemblies of the plurality of heat exchange assemblies, each of plurality of the heat exchange assemblies includes a first channel and a second channel which are used for allowing a refrigerant to pass through, and a communication portion communicated with the first channel and the second channel, multiple protrusions being provided on the first channel, the second channel and the communication portion, and a density of protrusions on the first channel and a density of protrusions on second channel are greater than a density of protrusions on the communication portion, and a size of each of the protrusions on the first channel is smaller than or equal to a size of each of the protrusions on the communication portion, and a size of each of the protrusions on the second channel is smaller than or equal to the size of each of the protrusions on the communication portion.

In some embodiments, each of the plurality of heat exchangers includes: a body, the body is provided with an accommodating cavity, and an end portion, along a length direction, of the body is provided with a first opening and a second opening; and a rib, the rib is provided in the accommodating cavity, and the rib isolates the accommodating cavity into a first cavity and a second cavity communicated to each other, the first cavity forms the first channel and is communicated with the first opening, and the second cavity forms the second channel and is communicated with the second opening, one of the first opening and the second opening is used to feed the refrigerant, and the other is used to discharge the refrigerant.

In some embodiments, the body includes a first plate and a second plate, the first plate and the second plate are connected and surrounded to form the accommodating cavity, and one side, towards the accommodating cavity, of the first plate and/or the second plate is provided with the rib.

In some embodiments, an end portion, adjacent to the communication portion, of the first plate and/or the second plate is provided with a fin blocking portion, and the fin blocking portion is formed by bending the body at another end portion of the body.

In some embodiments, the first opening and the second opening are holes which pass through the body.

In some embodiments, each of the protrusions on the communication portion is a strip-shaped protrusion, and the strip-shaped protrusion has an included angle with a length direction of each of the plurality of heat exchange assemblies.

In some embodiments, the strip-shaped protrusion is of arc-shaped.

In some embodiments, a cross-sectional area of the first channel is different from a cross-sectional area of the second channel.

In some embodiments, the cross-sectional area of the first channel is S1, and the cross-sectional area of the second channel is S2, $S1:S2=a$, $a \notin [0.5\text{-}1]$.

In some embodiments, $S1:S2=2:3$.

In some embodiments, the heat exchanger further includes: a first collecting pipe, the first collecting pipe is communicated with the first channel of each of the plurality of heat exchange assemblies respectively; a second collecting pipe, the second collecting pipe is communicated with the second channel of each of the plurality of heat exchange assemblies respectively; a liquid inlet pipe, communicated with the first collecting pipe; and an air outlet pipe, communicated with the second collecting pipe; wherein a pipe diameter of the liquid inlet pipe is smaller than a pipe diameter of the air outlet pipe, and/or a pipe diameter of the first collecting pipe is smaller than a pipe diameter of the second collecting pipe.

According to another aspect of the present disclosure, an air conditioner is provided, the air conditioner including a heat exchanger, and the heat exchanger is the above heat exchanger.

A technical solution of the present disclosure has the following beneficial effects.

1) Through the heat exchange assembly having the first channel, the second channel and the communication portion, circulation of the refrigerant in the first channel and the second channel is achieved, and a double-row heat exchanger is formed without the need to bend the heat exchange assembly, in the case of the same heat exchange capacity, the length of the heat exchanger is not increased, the mounting space is not limited, and the manufacturing cost is also reduced.

2) Through the large-density and large-size protrusions provided on the communication portion, the compression strength of the communication portion and the uniformity of a refrigerant flow field are ensured.

3) Through setting the cross-sectional areas of the first channel and the second channel in different modes, the pressure drop of the refrigerant in the channel is reduced, so the heat dissipation efficiency or refrigeration efficiency of the refrigerant is improved, and the heat exchange efficiency of the heat exchanger is improved.

BRIEF DESCRIPTION OF THE DRAWINGS

Drawings of the description, constituting a part of the present disclosure, are used to provide further understanding of the present disclosure, and exemplary embodiments of the present disclosure and descriptions of the exemplary embodiments are used to explain the present disclosure, and do not constitute improper limitation to the present disclosure. In the drawings.

Herein, the above drawings include the following reference sings:

10: heat exchange assembly; 11: first channel; 12: second channel;

20: fin;

30: body; 31: accommodating cavity; 32: first opening; 33: second opening; 34: first plate; 35: second plate; 36: rib;

40: protrusion;

50: air outlet pipe; and

60: liquid inlet pipe.

DETAILED DESCRIPTION OF THE EMBODIMENTS

It should be noted that embodiments in the present disclosure and features in the embodiments may be combined with each other in the case without conflicting. The present disclosure is described in detail below with reference to a combination of the drawings and the embodiments.

As shown in FIG. 2 to FIG. 7, according to an embodiment of the present disclosure, a heat exchanger is provided.

Figure 2:
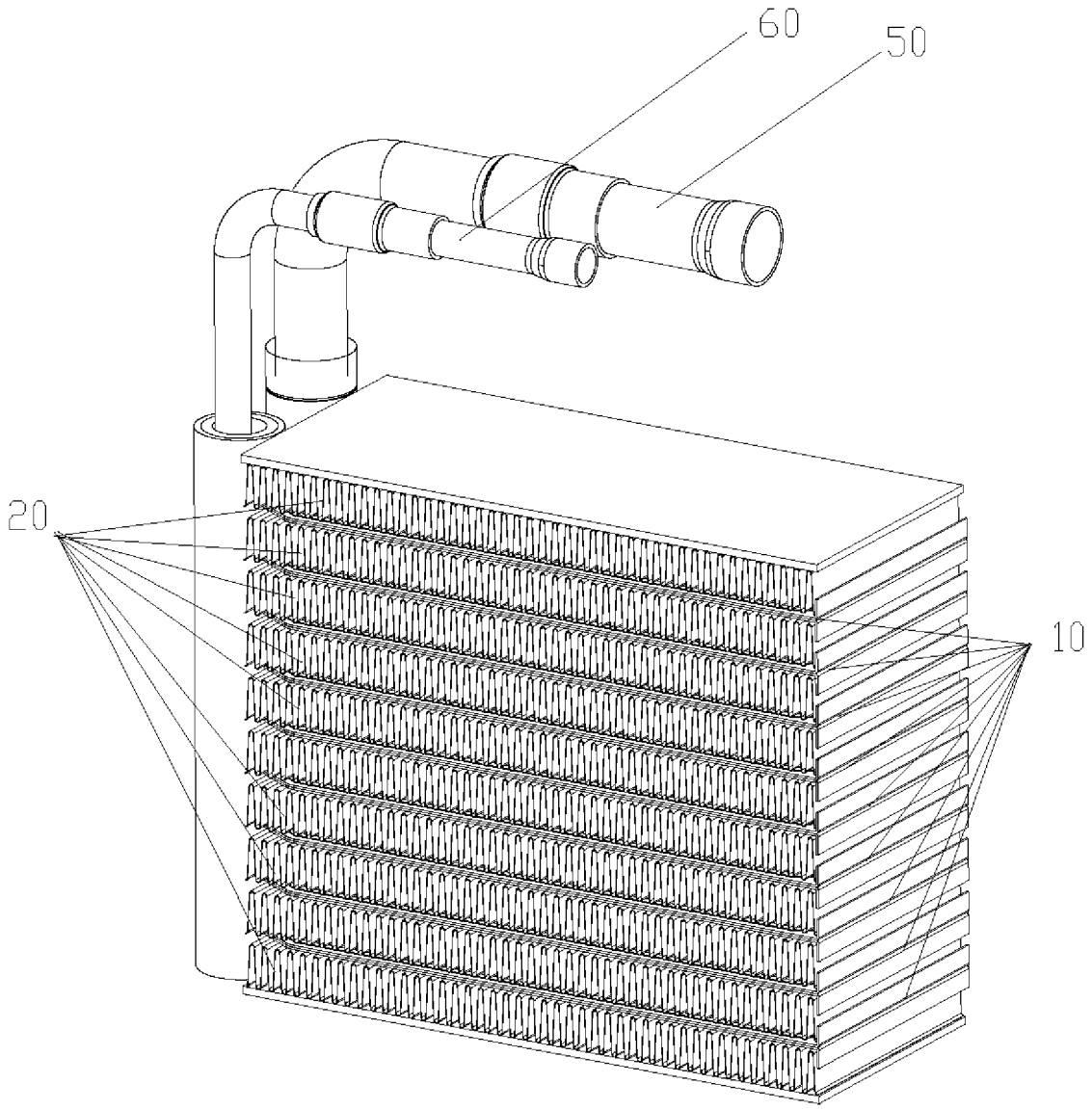
FIG. 2 shows a structure schematic diagram of an embodiment of the heat exchanger according to the present disclosure.

Specifically, as shown in FIG. 2, the heat exchanger includes a plurality of heat exchange assemblies 10 and a fin 20, the fin 20 is located between two adjacent heat exchange assemblies of the plurality of heat exchange assemblies 10, each of the plurality heat exchange assemblies 10 includes a first channel 11 and a second channel 12 which are used for allowing a refrigerant to pass through, and a communication portion communicated with the first channel 11 and the second channel 12, a plurality of protrusions 40 are provided on the first channel 11, the second channel 12 and the communication portion, and a density of protrusions on the first channel 11 and a density of protrusions on the second channel 12 are greater than a density of protrusions on the communication portion, and a size of each of the protrusions on the first channel 11 is smaller than or equal to a size of each of the protrusions on the communication portion, and a size of each of the protrusions on the second channel 12 is smaller than or equal to the size of each of the protrusions on the communication portion.

In this embodiment, through the heat exchange assembly having the first channel, the second channel and the communication portion, circulation of the refrigerant in the first channel and the second channel is achieved, and a double-row heat exchanger is formed without the need to bend the heat exchange assembly, in the case of the same heat exchange capacity, the length of the heat exchanger is not increased, the mounting space is not limited, and the manufacturing cost is also reduced. Through the large-density and large-size protrusions provided on the communication portion, the compression strength of the communication portion and the uniformity of a refrigerant flow field are ensured. Through setting the cross-sectional areas of the first channel and the second channel in different modes, the pressure drop of the refrigerant in the channel is reduced, so the heat dissipation efficiency or refrigeration efficiency of the refrigerant is improved, and the heat exchange efficiency of the heat exchanger is improved.

Figure 3:
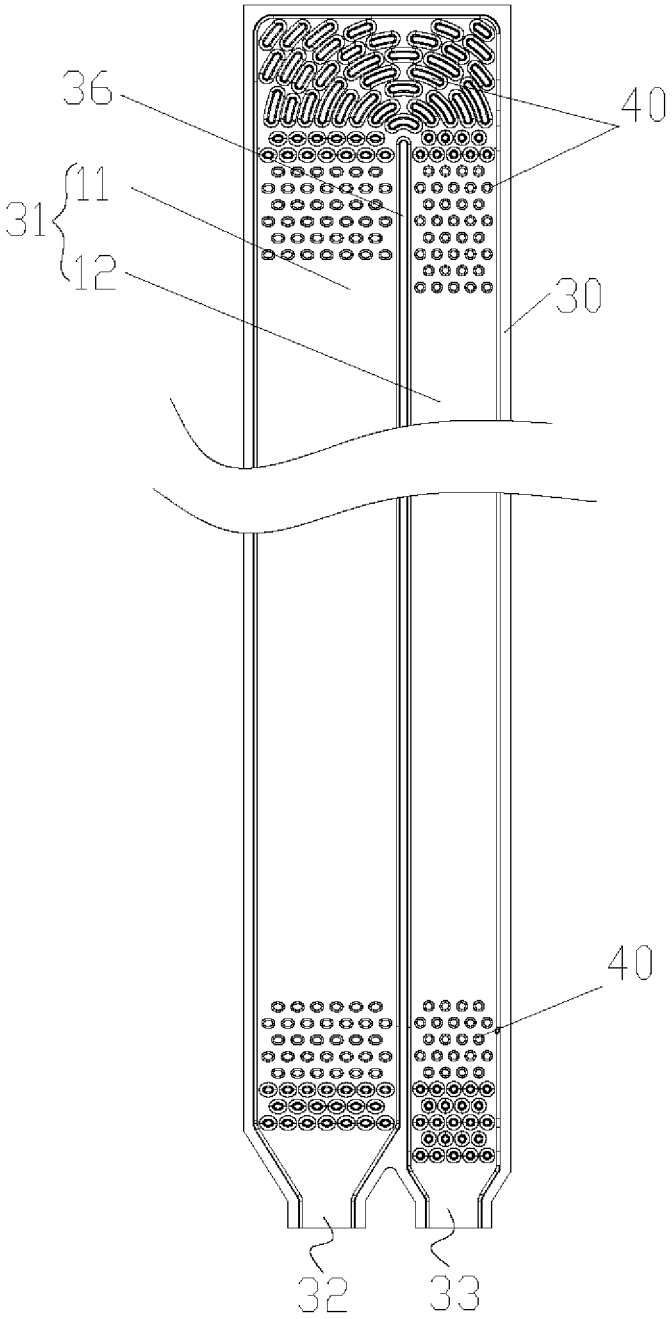
FIG. 3 shows a structure schematic diagram of Embodiment I of the heat exchange assembly of the heat exchanger according to the present disclosure.

As shown in FIG. 3, the heat exchanger 10 includes a body 30, the body 30 is provided with an accommodating cavity 31, and an end portion, along a length direction, of the body 30 is provided with a first opening 32 and a second opening 33; and a rib 36, and the rib 36 is provided in the accommodating cavity 31, and the rib 36 isolates the accommodating cavity 31 into a first cavity and a second cavity communicated to each other, the first cavity forms the first channel 11 and is communicated with the first opening 32, and the second cavity forms the second channel 12 and is communicated with the second opening 33, one of the first opening 32 and the second opening 33 is used to feed the refrigerant, and the other is used to discharge the refrigerant. Such a configuration is convenient for isolating the accommodating cavity 31 into the first channel 11 and the second channel 12 by the rib 36, herein, the cross-sectional areas of the first channel 11 and the second channel 12 are different. While a high-pressure refrigerant is flowed from the narrow first channel 11 to the wide second channel 12 and changed into a low-pressure refrigerant, because the external channel of the high-pressure refrigerant is changed from narrow to wide, it is convenient for changing the high-pressure refrigerant into the low-pressure refrigerant, thereby it is convenient for absorbing heat, or while the low-pressure refrigerant is flowed from the wide second channel 12 to the narrow first channel 11, because the external channel of the low-pressure refrigerant is changed from wide to narrow, it is convenient for changing the low-pressure refrigerant into the high-pressure refrigerant, thereby it is convenient for dissipating heat.

Figure 4:
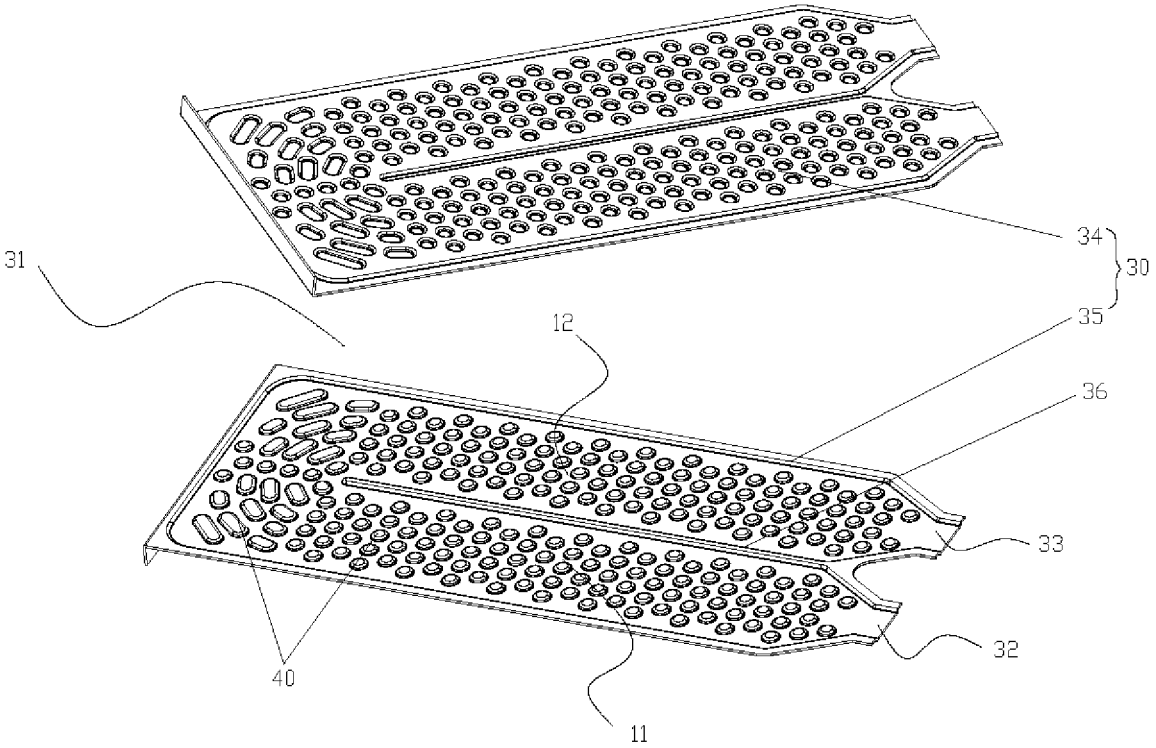
FIG. 4 shows a structure schematic diagram of Embodiment II of the heat exchange assembly of the heat exchanger according to the present disclosure.
Figure 6:
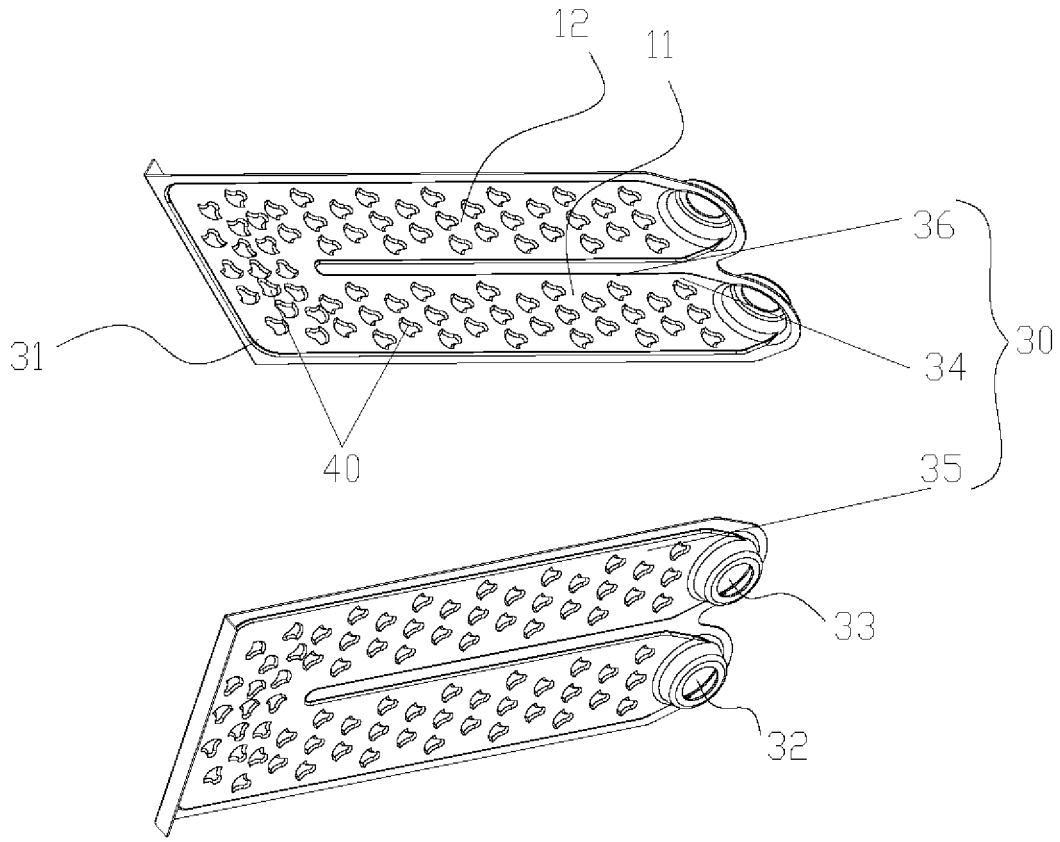
FIG. 6 shows a structure schematic diagram of Embodiment IV of the heat exchange assembly of the heat exchanger according to the present disclosure.

As shown in FIG. 4 and FIG. 6, the body 30 includes a first plate 34 and a second plate 35, the first plate 34 and the second plate 35 are connected and surrounded to form the accommodating cavity 31, and sides, towards the accommodating cavity 31, of the first plate 34 and the second plate 35 are respectively provided with the rib 36. Through mutual abutting connection of two ribs 36, interior of the accommodating cavity 31 is isolated into the first channel 11 and the second channel 12. Certainly, it is also possible that one side, towards the accommodating cavity 31, of the first plate 34 or the second plate 35 is provided with the rib 36, so that the interior of the housing is isolated into the first channel 11 and the second channel 12.

In this embodiment, an end portion, adjacent to the communication portion, of the first plate 34 or the second plate 35 is provided with a fin blocking portion. Certainly, it is also possible to set the fin blocking portions on both the first plate 34 and the second plate 35. The fin blocking portion is formed by bending the body 30 at another end portion of the body. The fin blocking portion is used for fixing and installing the fin, and thereby improving the assembling efficiency of the heat exchanger.

In this embodiment, the first opening 32 and the second opening 33 are holes which pass through the body 30, so that one of the first opening 32 and the second opening 33 is used to feed the refrigerant, and the other is used to discharge the refrigerant. In addition, superposition of the openings on plurality of bodies form a collecting cavity, so there is no need to set a collecting pipe additionally.

Figure 5:
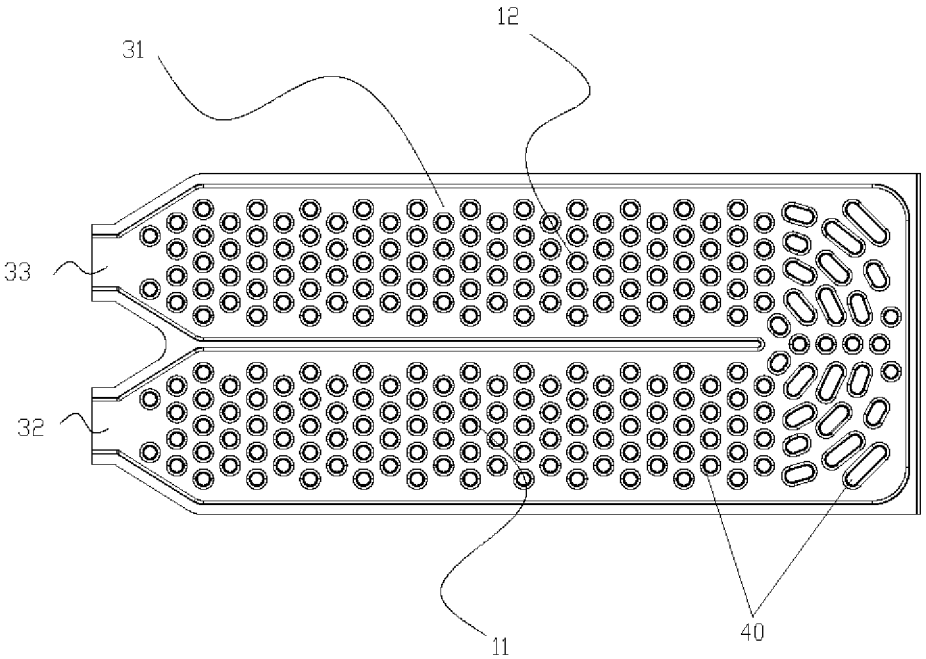
FIG. 5 shows a structure schematic diagram of Embodiment III of the heat exchange assembly of the heat exchanger according to the present disclosure.

As shown in FIG. 3 to FIG. 5, each of the protrusions 40 on the communication portion is a strip-shaped protrusion, and the strip-shaped protrusion has an included angle with a length direction of each of the plurality of heat exchange assemblies 10. Such a configuration is convenient for effective diversion of the refrigerant, and convenient for guiding the refrigerant from the first channel to the second channel or from the second channel to the first channel, and controlling the pressure of the refrigerant in the first channel 11 and the second channel 12 as required, thereby the heat exchange efficiency of the heat exchange assembly is improved.

As shown in FIG. 3, the strip-shaped protrusion is of arc-shaped. Such a configuration is convenient for the effective diversion of the refrigerant, and controlling the pressure of the refrigerant in the first channel 11 and the second channel 12 as required, thereby the heat exchange efficiency of the heat exchange assembly is improved.

In this embodiment, a cross-sectional area of the first channel 11 is different from a cross-sectional area of the second channel 12. Such a configuration improves the conversion efficiency between the high and low pressure states of the refrigerant conducted in the first channel and the second channel, so as to improve the heat dissipation efficiency or refrigeration efficiency of the refrigerant, thereby the heat exchange efficiency of the heat exchanger is improved.

As shown in FIG. 3, the cross-sectional area of the first channel 11 is S1, and the cross-sectional area of the second channel 12 is S2, $S1:S2=a$, $a \notin [0.5 \sim 1]$. A preferred ratio is $S1:S2=2:3$. Such a configuration reduces the pressure drop of the refrigerant in the channel, and increases a mass flow of the refrigerant, thereby the heat exchange rate and energy efficiency of the heat exchanger are improved.

Further, in other embodiments, the heat exchanger further includes a first collecting pipe, a second collecting pipe, a liquid inlet pipe 60 and an air outlet pipe 50, the first collecting pipe is communicated with the first channel 11 of each of the plurality of heat exchange assemblies 10 respectively, the second collecting pipe is communicated with the second channel of each of the plurality of heat exchange assemblies 10 respectively, the liquid inlet pipe 60 is communicated with the first collecting pipe, and the air outlet pipe 50 is communicated with the second collecting pipe; herein a pipe diameter of the liquid inlet pipe 60 is smaller than a pipe diameter of the air outlet pipe 50, or a pipe diameter of the first collecting pipe is smaller than a pipe diameter of the second collecting pipe. Certainly, it is possible that the pipe diameter of the liquid inlet pipe 60 is smaller than the pipe diameter of the air outlet pipe 50 and the pipe diameter of the first collecting pipe is smaller than the pipe diameter of the second collecting pipe. Such a configuration reduces cavity volume and weight of the collecting pipe or the liquid inlet pipe 60, and reduces refrigerant charge amount and material cost of the heat exchanger.

The heat exchanger in the above embodiments may also be used in the technical field of air conditioning devices, namely according to another aspect of the present disclosure, an air conditioner is provided. The air conditioner includes a heat exchanger, and the heat exchanger is the heat exchanger in the above embodiments.

Figure 7:
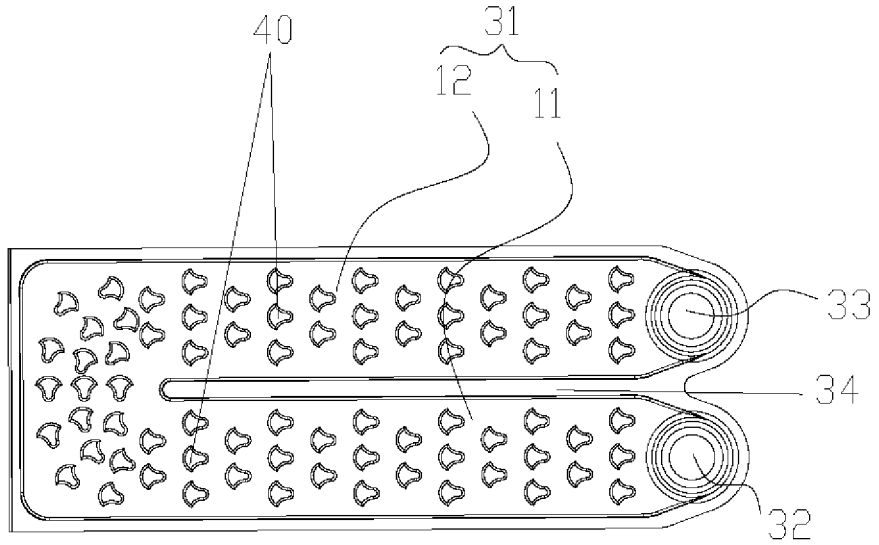
FIG. 7 shows a structure schematic diagram of Embodiment V of the heat exchange assembly of the heat exchanger according to the present disclosure.

As shown in FIG. 6 and FIG. 7, a cross section of each of the plurality of protrusions 40 is a triangular-like structure, and one corner of the protrusion 40 located in the first channel 11 is provided towards the first opening 32, or one corner of the protrusion 40 located in the second channel 12 is provided towards the second opening 33. Certainly, it is possible that the corner of the protrusion 40 located in the first channel 11 is provided towards the first opening 32 and the corner of the protrusion 40 located in the second channel 12 is provided towards the second opening 33. The triangular-like structure may be a right-angled triangle structure or may be a triangular structure of which each of the corner portions is arc. Such a configuration is convenient for the effective diversion of the refrigerant, and controlling the pressure of the refrigerant in the first channel 11 and the second channel 12 as required, thereby the heat exchange efficiency of the heat exchange assembly is improved.

As shown in FIG. 2, there are a plurality of heat exchange assemblies 10, and the plurality of heat exchange assemblies 10 are provided at intervals. The heat exchanger further includes: a fin 20, the fin 20 is located between two adjacent heat exchange assemblies of the plurality of heat exchange assemblies 10, the fin 20 is of wave-shaped, and a width of the fin 20 is the same as a width of the body 30. Such a configuration is convenient for fully transferring heat to the fin through the refrigerant, and then exchanging the heat with the outside.

Figure 1:
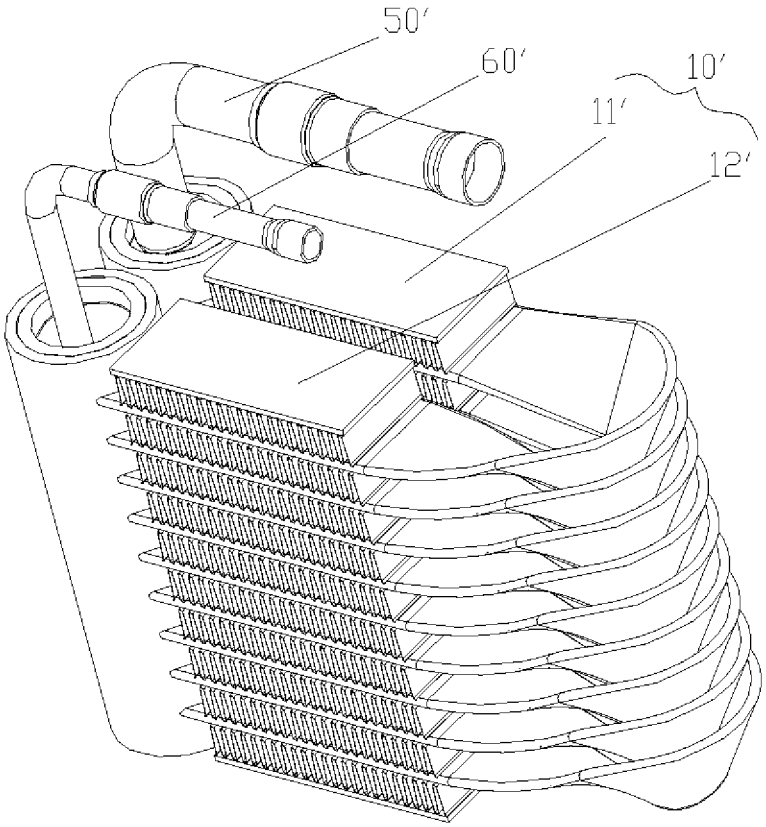
FIG. 1 shows a structure schematic diagram of a heat exchanger in a related art.

As shown in FIG. 1, in a related art, a core of a conventional microchannel heat exchanger is mainly manufactured by using a microchannel flat tube 10', a fin, a side plate, an air outlet pipe 50', and a liquid inlet pipe 60'. A diameter of a collecting pipe of the conventional microchannel heat exchanger is greater than a width of the microchannel flat tube. A section of a core portion without the fin needs to be reserved in a bending area of the conventional double-row bending microchannel heat exchanger, and there is a gap of 4 mm to 7 mm after bending. Because the diameter of the collecting pipe of the conventional microchannel heat exchanger is greater than the width of the microchannel flat tube, the cavity volume and weight of the collecting pipe are relatively large, causing the refrigerant charge amount and material cost of the heat exchanger being relatively large. Because a section of the core portion without the fin is reserved in the bending area, the length of the heat exchanger needs to be increased in order to guarantee the same heat exchange capacity, causing the refrigerant charge amount and material cost of the heat exchanger being relatively large; because a section of the core portion without the fin is reserved in the bending area, the number of the fins needs to be doubled, causing the assembly of the heat exchanger requiring more time, and the manufacturing cost of the heat exchanger being increased; and'the microchannel flat tube 10' includes a first microchannel flat tube 11 and a second microchannel flat tube 12', because there is a gap of 4 mm to 7 mm between the first microchannel flat tube 11' and the second microchannel flat tube 12' after bending, a width of the mounting space of the heat exchanger is increased, so that the use of this type of heat exchanger is limited.

In the present disclosure, the diameter of the collecting pipe of, the heat exchanger is smaller, the cavity volume and weight of the collecting pipe are reduced, and the refrigerant charge amount and material cost of the heat exchanger are reduced, or the collecting pipe may also be replaced by the collecting cavity formed by the superposition of the bodies provided with the openings; the heat exchange assembly does not require the bending area, and the length of the heat exchanger does not need to be lengthened, so the refrigerant charge amount and material cost of the heat exchanger are reduced; and an assembly process of a product structure of the present disclosure is unchanged from a related structure, not only an additional process is not increased, but also the assembly processes, caused by the increase of the fins, of the conventional double-row bending microchannel heat exchanger is reduced, so the manufacturing cost of the heat exchanger is reduced.

The above are only the preferred embodiments of the present disclosure, and are not used to limit the present disclosure. Various modifications and changes may be made to the present disclosure by those skilled in the art. Any modifications, equivalent replacements, improvements and the like made within the spirit and principle of the present disclosure shall be included in a scope of protection of the present disclosure.

What is claimed is:

1. A heat exchanger, comprising a plurality of heat exchange assemblies (10) and a fin (20), the fin (20) is located between two adjacent heat exchange assemblies (10) of the plurality of heat exchange assemblies (10), wherein each of the plurality of heat exchange assemblies (10) comprises a first channel (11) and a second channel (12) which are used for allowing a refrigerant to pass through, and a communication portion communicated with the first channel (11) and the second channel (12), a plurality of protrusions (40) being provided on the first channel (11), the second channel (12) and the communication portion, and a density of protrusions on the first channel (11) and a density of protrusions on the second channel (12) are greater than a density of protrusions on the communication portion, and a size of each of the protrusions on the first channel (11) is smaller than or equal to a size of each of the protrusions on the communication portion, and a size of each of the protrusions on the second channel (12) is smaller than or equal to the size of each of the protrusions on the communication portion.

2. The heat exchanger as claimed in claim 1, wherein each of the plurality of heat exchanger assemblies (10) comprises:

a body (30), wherein the body (30) is provided with an accommodating cavity (31), and an end portion, along a length direction, of the body (30) is provided with a first opening (32) and a second opening (33); and a rib (36), wherein the rib) is provided in the accommodating cavity (31), and the rib (36) isolates the accommodating cavity (31) into a first cavity and a second cavity communicated to each other, the first cavity forms the first channel (11) and is communicated with the first opening (32), and the second cavity forms the second channel (12) and is communicated with the second opening (33), one of the first opening (32) and the second opening (33) is used to feed the refrigerant, and the other s used to discharge the refrigerant.

3. The heat exchangers claimed in claim 2, wherein the body (30) comprises a first plate (34) and a second plate (35), the first plate (34) and the second plate (35) are connected and surrounded to form the accommodating cavity (31), and one side, towards the accommodating cavity (31), of the first plate (34) is provided with the rib (36), or one side, towards the accommodating cavity (31), of the second plate (35) is provided with the rib (36), or there are a plurality of ribs (36), sides, towards the accommodating, cavity (31), of the first plate (34) and the second plate (35) are provided with he plurality of ribs (36).

4. The heat exchanger as claimed in claim 3, wherein an end portions adjacent to the coim ITU/ cation portion, of the first plate (34) and the second plate (35) are provided with fin blocking portions, or an end portion, adjacent to the communication portion. of the first plate (34) is provided with a fin blocking portion, or an end portion, adjacent to the communication portion, of the secondplate (35) is provided with a fin blocking portion, and the fin blocking portion is formed by bending the body (30) at another end portion of the body (30).

5. The heat exchanger as claimed claim 2. wherein the first opening (32) and the second opening (33) are holes which pass through the body (30).

6. The heat exchanger as claimed in claim 1. wherein-wheren each of the protrusions (40) on the communication portion is a strip-shaped protrusion, and the strip-shaped protrusion has an included angle a length direction of each of the plurality of heat exchange assemblies (10).

7. The heat exchanger as claimed in claim 6, wherein the strip-shaped protrusion is of arc-shaped.

8. The heatexchanger as claimed in claim 1, wheren a cross-sectional ea of he first channel (11) is different from a cross-sectional area of the second channel (12).

9. The heat exchanger as claimed in claim 8, wherein the cross-sectional area of the first channel (11) is S1, and the cross-sectional area of the second channel (12) is S2, S1 a$\notin$[0.5~1].

10. The heat exchanger claimed in claim 9, wherein S1:S2=2.3.

11. The heat exchanger as claimed in claim 1, wherein the heat exchanger further comprises;

a first collecting pipe, wherein the first, collecting pipe is communicated with the first channel (11) of each of the plurality of heat exchange assemblies (10) respectively, a second collecting pipe, wherein the second collecting pipe is communicated with the second channel (12) of each of the plurality of heat exchange assemblies (10) respectively;

a liquid inlet pipe (60), communicated with the first collecting pipe; and an air outlet pipe (50), communicated with the second collecting pipe;

wherein a pipe diameter of the liquid inlet pipe (60) is smaller than a pipe diameter of the air outlet pipe (50), and a pipe diameter of the first collecting pipe is smaller than a pipe diameter of the second collecting pipe, or a pipe diameter of the liquid inlet pipe (60) is smaller than a pipe diameter of the air outlet pipe (50), or a pipe diameter of the first collecting pipe is smaller than a pipe diameter of the second collecting pipe.

12. An air conditioner, comprising a heat exchanger, vheren the heat exchanger is the heat exchanger as claimed in claim 1.

13. The air conditioner as claimed in claim 12, wherein each of the plurality of heat exchanger assemblies (10) comprises:

a body (30), wherein the body (30) is provided with an accommodating cavity (31), and an end portion, along a length direction, of the body (30) is provided with a first opening (32) and a second opening (33); and a rib (36), wherein the rib (36) is provided in the accommodating cavity (31), and the rib (36) isolates the accommodating cavity (31) into a first cavity and a second cavity communicated to each other, the first cavity forms the first channel (11) and is communicated with the first opening (32), and the second cavity forms the second channel (12) and is communicated with the second opening (33), one of the first opening (32) and the second opening (33) is used to feed the refrigerant, and the other is used to discharge the refrigerant.

14. The air conditioner as claimed in claim 13, wherein the body (30) comprises first plate (34) and a second, plate (35), the first plate (34) and the second plate (35) arc connected and surrounded to form the accommodating cavity (31), and one side, towards the accommodating cavity (31), of the first plate (34) is provided with the rib (36), or one side, towards the accommodating ca (31), of the second plate (35) is provided with the rib (36), or there are a plurality of ribs (36), sides. towards the accommodating cavity (31), of the first plate (34) and the second plate (35) are provided with the plurality of ribs (36).

15. The air conditioner as claimed in claim 14, wherein end portions, adjacent to the communication portion,of the first plate (34) and the second plate (35) are provided with fin blocking portions, or an end portion, adjacent to the communication portion, of the first plate (34) is provided with a fin blocking portion, or an end portion, adjacent to the communication portion, of the second plat (35) is provided with a fin blocking portion, and the fin blocking portion formed by bending the body (30) at another end portion of the body (30).

16. The air conditioner as claimed in claim 13, vherein the first opening (32 and the second opening (33) are holes which pass through the body (30).

17. The air conditioner as claimed in claim 12, wherein each of the protrusions (40) on the communication portion is a strip-shaped protrusion, and the strip-shaped protrusion has an included angle with a length direction of each of the plurality of heat exchange assemblies (10).

18. The air conditioner as claimed in claim 17, wherein the strip-shaped protrusion is of arc-shaped.

19. The air conditioner as claimed in claim 12, wherein a cross-sectiona first channel (11) is different from a cross-sectional area of the second channel (12).

20. The air conditioner as claimed in claim 19, wherein the cross-sectional area of the first channel (11) is S1, and the cross-sectional area of the second channel (12) is S2, $S1:S2=a$, $a \notin [0.5 \sim 1]$.

* * * * *